United States Patent [19]

Lorenz

[11] Patent Number: 4,960,238

[45] Date of Patent: Oct. 2, 1990

[54] 2-PIECE PIZZA BOX WITH CUT-OUT CORNERS

[75] Inventor: Achim R. Lorenz, Marietta, Ga.

[73] Assignee: MacMillan Bloedel Containers, Atlanta, Ga.

[21] Appl. No.: 339,798

[22] Filed: Apr. 18, 1989

[51] Int. Cl.[5] ..... B65D 5/20

[52] U.S. Cl. ..... 229/125.29; 229/114; 229/190

[58] Field of Search ..... 229/125.27, 125.28, 229/125.29, 114, 906, 190

[56] References Cited

U.S. PATENT DOCUMENTS

| | | | |
|---|---|---|---|
| 2,304,362 | 12/1942 | Huye | 229/125.28 |
| 3,027,062 | 3/1962 | Huss et al. | 229/114 |
| 3,193,174 | 7/1965 | Glasband et al. | 229/125.29 |
| 3,195,798 | 7/1965 | Wilson | 229/125.27 |
| 3,326,447 | 6/1967 | Williamson | 229/125.28 |
| 3,377,017 | 4/1968 | Rosenfield | 229/114 |
| 3,410,475 | 11/1968 | Wagner | 229/125.29 |
| 3,966,112 | 6/1976 | Gordon | 229/23 BT |
| 4,232,816 | 11/1980 | Johnson et al. | 229/114 |
| 4,470,538 | 9/1984 | Heathcock et al. | 229/125.29 |
| 4,804,137 | 2/1989 | Harby | 229/125.28 |

FOREIGN PATENT DOCUMENTS

| | | | |
|---|---|---|---|
| 2344468 | 10/1977 | France | 229/125.28 |
| 695557 | 9/1965 | Italy | 229/125.28 |

*Primary Examiner*—Gary E. Elkins

*Attorney, Agent, or Firm*—Beveridge, DeGrandi & Weilacher

[57] ABSTRACT

A two piece container including a tray piece for holding an item and a cover piece adapted to telescopically fit over the tray is disclosed. Each container piece has a first wall and sidewalls which extend from and taper outwardly from the first wall. The sidewalls of the tray piece meet at corners which have cut-out sections to provide for inward flexibility of the tray sidewalls when the cover is fitted over the tray. A blank for forming the tray piece according to the present invention is also disclosed.

16 Claims, 2 Drawing Sheets

FIG. 1
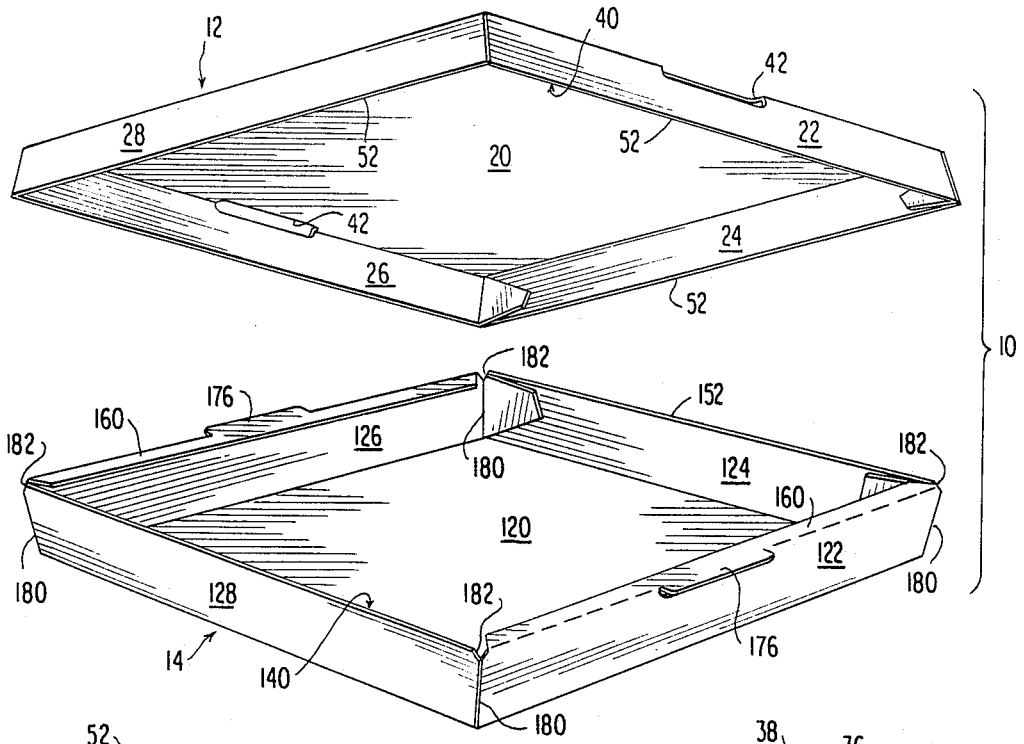
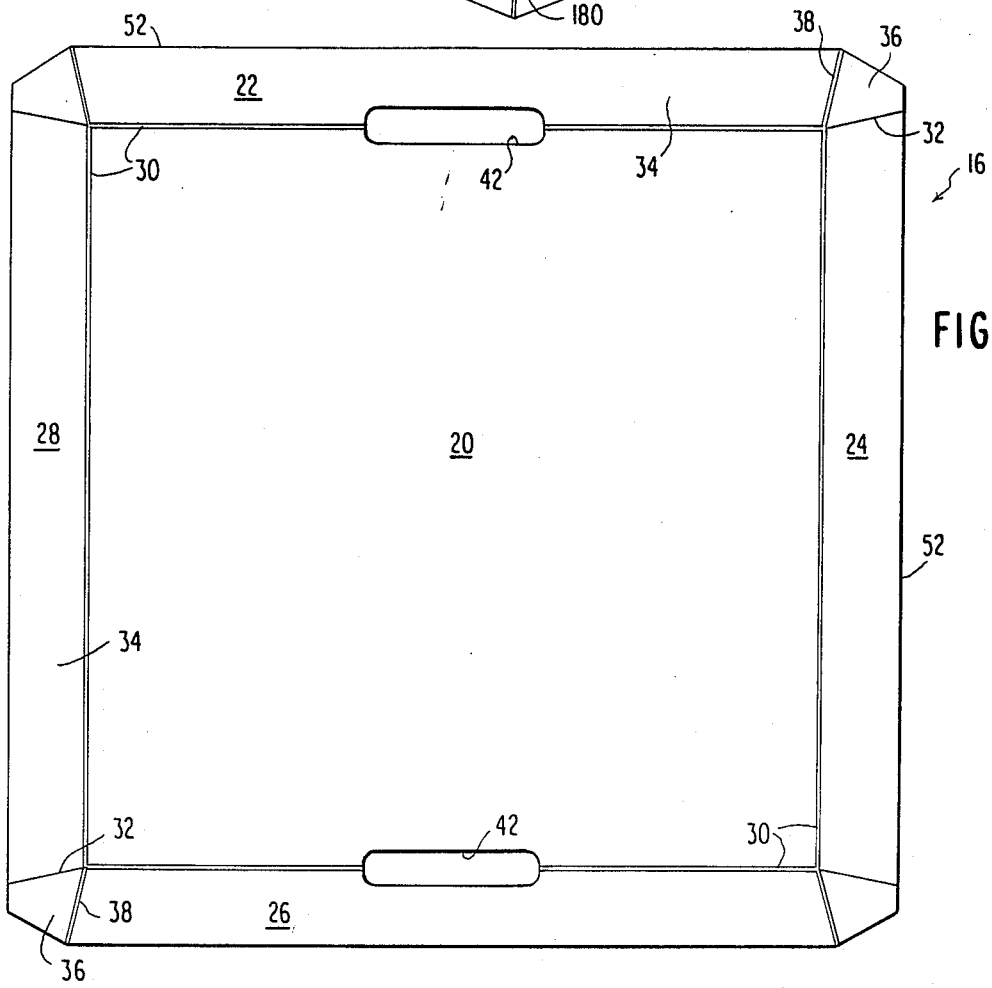
FIG. 2

2-PIECE PIZZA BOX WITH CUT-OUT CORNERS

BACKGROUND OF THE INVENTION

The present invention pertains to a two piece container suitable for food items or the like which container comprises a cover that telescopically receives a tray having V-cut corners to provide inward flexibility for its sidewalls. The present invention also pertains to a blank for forming the tray piece in accordance with the invention.

A conventional type of container for pizza generallY has a relatively large, rectangular bottom wall portion and a top wall portion having the same dimensions as the bottom wall. Four sidewalls are hingeably connected to the bottom wall. One of the sidewalls also forms a hinge which connects the top wall to the bottom wall so that the top wall can be folded over onto the bottom to lock the container and enclose the pizza.

Pizza boxes of the conventional type often are stored as flat blanks or in squared-up condition. If flat blanks are stored, the blanks must be squared-up before their use and this increases the effort involved in the preparation of each food product for carry out. On the other hand, if the boxes are stored in squared-up form, they must be stacked on top of each other and therefore require additional space.

In order to overcome the above-mentioned problems relating to the storage of food containers, nestable containers have been provided. For example, U.S. Pat. No. 3,027,062 discloses a combination tray and cover, which according to the patentee, are constructed from blanks of identical size and contour. The side walls of each tray and cover piece include, located at the top edge thereof, a locking tab having a male portion delineated by a slit and a guide tab. To interlock the tray and cover, first the cover is positioned over the tray so that the locking tabs of the two pieces are placed in contact and then the cover is rotated with respect to the tray until the male portions of the locking tabs of each piece engage in the slits of the other piece. Such means for interlocking are somewhat complicated in requiring particular alignment of and rotation of the pieces.

U.S. Pat. No. 4,474,324 is a carton of the telescoping type wherein a cover piece fits over a tray piece. A common blank for forming each of the cover and tray pieces is provided with additional score lines so that the corners of the tray piece can be "pinched" together to permit the cover piece to slide over the sidewalls of the tray piece.

Other prior art has been directed to providing reliable, but somewhat less complicated locking means for two-piece containers. For example, in U.S. Pat. No. 2,739,752 there is shown a 2-piece container including a cover and a deep, box-like "tray" which has tapering side walls. Handles are provided on the sides of the tray. Slots in the cover receive the handles to lock the container closed when the handles are folded over.

U.S. Pat. No. 4,470,538 shows a carton of the type having identical tray and cover members which hingeably attach to each other and are folded over to lock the container.

Still other containers and food cartons are shown in U.S. Pat. Nos. 3,195,798; 3,795,360; 3,926,362; 3,984,027, 4,431,128; 4,339,068; and 4,470,538.

SUMMARY OF THE INVENTION

The container according to the present invention comprises two complementary container pieces, a tray piece and a cover piece which is closable over the tray. The container of the instant invention is particularly suited for enclosing food items, and in particular, relatively large, flat food items such as pizza for example. Each container piece according to the present invention includes a first or bottom wall and sidewalls. The sidewalls of at least the tray piece taper outwardly from their connection with their bottom wall so that when the two complementary pieces are interlocked, the cover piece telescopes part-way over the central portions of the sidewalls of the tray piece. In the preferred embodiment, each corner has a V-shaped cut. These cut-out corners ensure that the tray sidewalls will flex inwardly under forces exerted by the sidewalls of the tray when the cover and tray are urged together to lock the containers. Also, in the preferred embodiment, the perimeter defined by the upper edges of the tray sidewalls is equal to or even just slightly greater than the perimeter of the bottom wall of the cover. Where the pieces are closed by urging the tray sidewall upper edges into contact with the cover's bottom wall, the tray sidewalls flex to be telescopically received within the cover. This inward flexing is facilitated by the cut-out corners of the tray.

It is contemplated that the sidewalls of both the tray and the cover pieces taper outwardly from their bottom walls to provide for telescopic interlocking in accordance with the present invention. This tapering configuration also provides for nesting and stacking of the any number of cover pieces and a corresponding number of tray pieces according to the invention. It is also contemplated that, in a business using large numbers of containers according to the invention, such as a pizza shop, the complementary pieces would be nested in two stacks to minimize the space required for their storage. If desired, the squared-up, nestably-stacked covers and trays could be stored and fed from a dispensing apparatus. Further, after the box is opened by the customer, the customer, for example, can place the tray containing the pizza within the cover to conserve space.

Locking means are provided according to the preferred embodiment of the invention to lock the container pieces together in telescopic relationship. A preferred locking means comprises tabs on at least two opposing sidewalls of the tray piece. These tabs are received through corresponding slots in the cover piece when the pieces are urged together. This provides a very reliable locking arrangement which is resistant to accidental opening due to the slightly flexed condition of the tray sidewalls in contact with the faces of the sidewalls of the cover. Because of the inherent flexibility of the materials from which the preferred container pieces are constructed, however, this resistance to accidental opening does not hinder authorized opening of the closed container. Indeed, the cover and tray can be opened by finger force applied to push the tray tabs inwardly while pulling the sidewalls of the cover over the tabs.

The container of the present invention comprises a first piece which telescopically receives a second container piece therein t form the container. Each of the pieces includes a first wall and sidewalls which extend upwardly from such first wall and which are joined to form corners. The corners of the second piece have cut-out sections.

A blank for forming a tray piece for a two-piece container according to the present invention includes a first wall section and sidewall sections which are foldable upwardly from their bottom wall section. Each sidewall section has a generally trapezoidally-shaped central portion with tapering edges which meet to form corners having cut-out sections for the tray.

BRIEF DESCRIPTION OF THE DRAWINGS

Further aspects and features of the invention will become even more apparent from the following detailed description and drawings wherein like parts are given like reference numerals, and in the appended claims. In the drawings:

FIG. 1 is a perspective view of a container including a cover piece and a complementary tray piece according to the present invention:

FIG. 2 is a plan view of a blank for forming the cover piece of the container of FIG. 1;

DETAILED DESCRIPTION OF THE PREFERRED EMBODIMENTS

Figure 3:
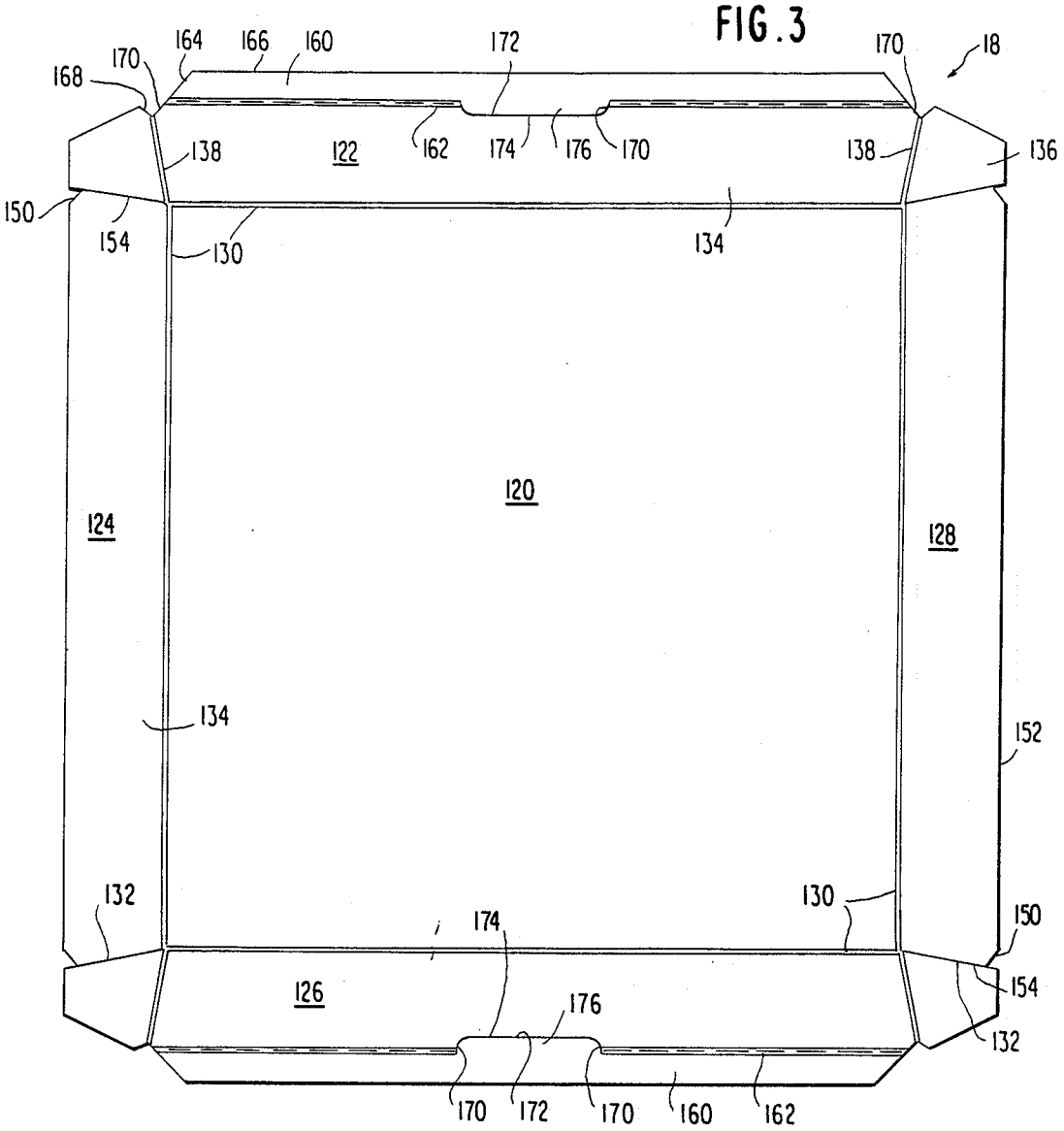
FIG. 3 is a plan view of a blank for forming the tray piece of the container of FIG. 1.

In FIG. 1, there is shown in perspective view, a container 10 according to the present invention. Container 10 is shown as comprising two complementary container pieces 12 and 14, which will be referred to herein as cover piece 12 and tray piece 14. Configured as shown in FIG. 1, preferred container 10 is suitable for transporting, protecting and thermally insulating large food items. Indeed, it is contemplated that container 10 is ideally suited for enclosing a relatively large, flat food item, such as a pizza, and therefore, each complementary container piece 12 and 14 has a relatively large, generally rectangular bottom wall and relatively short sidewalls as will be discussed in detail infra.

Preferably, each complementary piece 12 and 14 of container 10 is formed from a heavy paper board and/or corrugated paper material. To ensure adequate strength, the paper or paper board material can be provided in a "double-face" arrangement wherein a fluted center sheet is sandwiched between two flat sheets to form the inner and outer surfaces of the complementary pieces. If formed of paper or paper board material, the inner and/or the outer surfaces of each complementary container piece 12 and 14 can be coated with any conventional coating commonly applied to non-plastic food containers. The coating is of the type for making the paper board and corrugated paper resistant to the penetration of grease or the like. With such a coating, the container pieces 12 and 14 could be used to provide serving surfaces for holding food while it is being consumed without the problem of grease penetration. Alternatively, as appreciated by one of ordinary skill in the art, container pieces 12 and 14 could be formed with metal foil, plastic sheet material, foamed plastic or any other well-known material for fabricating containers for food or the like. Whatever the selected material, it should be somewhat flexible and resilient, but it must provide the requisite strength for protecting the contents of the container.

With reference to FIG. 1, and to FIG. 2 which is a plan view of a blank 16 for forming cover 12, the cover includes a generally rectangular first or "bottom" wall 20 and relatively short sidewalls 22, 24, 26, and 28. Actually, as is apparent from the drawings, "bottom" wall 20 becomes the upper wall of the completed container 10, but for purposes of discussion, reference to the "bottom" walls of both cover 12 and tray 14 will be made. Sidewalls 22, 24, 26, and 28 are connected to the wall 20 by fold or score lines 30 in a manner well known to those of ordinary skill in the art. Sidewalls 22 and 26 are separated from their adjacent sidewalls 24 and 28 by cut lines 32. Fold or score lines 30 and cut lines 32 provide each of sidewalls 22, 24, 26 and 28 with a generally trapezoidally-shaped central portion 34. Opposing sidewalls 22 and 26 also are provided with glue flaps 36 connected by fold or score lines 38 to the central portions 34 thereof.

Cover 12 is formed by "squaring-up" blank 16. To square-up blank 16, glue flaps 36 are folded upwardly, perpendicular to their sidewall central portions 34 along their fold lines 38. Sidewalls 22, 24, 26, and 28 then are folded upwardly with respect to bottom wall 20 along fold or score lines 30 whereafter the glue flaps 36 are glued to the inner surfaces of adjacent sidewalls 24 and 28. Any conventional adhesive or other means such as stapling can be used for squaring-up blank 16. Sidewalls 22, 24, 26 and 28 are folded upwardly such that the fold lines 38 align with the cut lines 32. In this way, as seen from FIG. 1, the sidewalls 22, 24, 26, and 28 of container piece 12 taper outwardly from their bottom wall 20 to form an opening 40 that has a larger perimeter than the bottom wall. Adjacent sidewalls, of the cover 12 (and the tray 14) meet at approximately right angles to form the four corners of cover 12.

Opposite sidewalls 24 and 28 of cover 12 thus are identical and, as seen from FIG. 2, are comprised only of their central portions 34. It is understood however, that glue flaps 36 could be provided on sidewalls 24 and 28 rather than sidewalls 22 and 26.

Cover 12 is also provided with slots 42. As best see from FIG. 2, each slot 42 is provided in a portion of bottom wall 20, at its outer periphery, and in a portion of each of the opposing sidewalls 22 and 26. Indeed, in FIG. 2, slots 42 are centrally located along the fold lines 30 of sidewalls 22 and 26. In their longitudinal direction, the slots 42 are substantially bisected by fold or score lines 30. As will be understood by those of ordinary skill in the art, it is not necessary that portions of the bottom wall 20 be punched-out or cut to form slots 42; the slots 42 just as well could be provided only in the sidewalls. Indeed slots 42 could be provided in any two opposing sidewalls of cover 12.

Tray 14 will be described in detail with respect to FIG. 1 and FIG. 3 which shows, in plan view the blank 18 for forming the tray. Tray 14 likewise includes a first or "bottom" wall 120 and four sidewalls 122, 124, 126 and 128 connected to the wall 120. Like sidewalls 22, 24, 26 and 28 of cover 12, tray sidewalls 122, 124, 126, and 128 each have a generally trapezoidally-shaped central section which will be referred to as central portion 134. Central portions 134 likewise are defined by fold or score lines 130 which delineate the central portions from bottom wall 120 and by cut lines 132, which separate the four sidewalls 122, 124, 126, and 128 from each other.

Tray sidewalls 124 and 128 each have edges 150 which connect their respective top edges 152 to their opposite side edges 154 which edges 154 are defined by cut lines 132. Otherwise, sidewalls 124 and 128 have a configuration similar to cover sidewalls 24 and 28.

Tray sidewalls 122 and 126 are provided with glue flaps 136 delineated by fold or score lines 138. Again, it is understood that glue flaps 136 could be provided at the longitudinal ends of sidewalls 124 and 128 instead. Each of sidewalls 122 and 126 also includes a fold-over portion 160 which is connected to the upper part of its central portion 134 by a fold or score line 162. Portion 160 also has a generally trapezoidal shape. Portion 160 is delineated by tapering side edges 164 that connect its base as defined by fold or score lines 162 to its upper edge 166. As best seen from FIG. 3, the side edges 164 of each of tray sidewalls 122 and 128 extend past fold lines 162 to intersect glue flap fold lines 138. At its intersection with glue flap fold line 138, each edge 164 connects to a second beveled or tapering edge 168 to form a V-shaped cut 170.

As also seen from FIG. 3, the fold or score lines 162 of sidewalls 122 and 126 do not extend the full length across the base of their portions 160. Rather, each fold or score line 162 is interrupted at the opposite edges 170 of a cut line 172 in portion 160. A central edge 174 formed by the cut line 172 is parallel with the fold or score line 162 and connects the two opposite rounded edges 170 of the cut line to form a tab 176. It is contemplated that each of tray sidewalls 122 and 126 could be provided with more then one tab 176 as desired. If so, cover sidewalls 22 and 26 would have a corresponding number of slots 42.

When tray 14 is squared-up, tabs 176 protrude from folded-over portions 160 and thus the tabs lie in the same generally horizontal plane as the portion 160. Folded-over portions 160 and their oppositely-extending tabs 176 have a relatively high degree of resistance to pivotal motion about the fold line 162. Thus, if cover 12 accidentally were pulled upwardly with respect to tray 14 when interlocked therewith, tabs 176 would resist being rotated further upwardly about fold line 162 to prevent the tabs from sliding through the slots to disengage the cover from the tray.

Tray 14 is squared-up for use in a manner similar to that for cover 12. First, glue flaps 136 may be folded upwardly and perpendicular to their respective sidewall central portions 134. Thereafter, all four sidewalls 122, 124, 126 and 128 are folded upwardly toward each other along their fold or score lines 130 until the fold lines 138 align with edges 154 of sidewalls 124 and 128. As a result, tapered edges 150 of sidewalls 124 and 128 come into alignment with like tapered edges 168. Then as seen from FIG. 1, the squared-up tray 14 is provided with cut-out corners 180 having V-shaped cuts 182 therein. As is also understood from FIG. 1 and described previously, portions 160 are folded-over inwardly to lie in a plane substantially parallel with that of the bottom wall 120. Due to the cut line 172, as portions 160 are folded over inwardly, tabs 176 automatically project outwardly from their sidewalls 122 and 126 in a direction opposite to that in which portions 160 are folded-over.

Complementary container pieces 12 and 14 are interlocked to contain an item by first orienting the two pieces so that tabs 176 of the tray will be received by the slots 42 of the cover and then urging the pieces together in telescopic engagement. The length of tabs 176, that is, their measure between tab edges 170, along the edge 174, of course is less than the length of slots 42 to permit easy locking and unlocking of the container pieces. This locking arrangement provides another advantage as well, particularly where container 10 is dedicated to use for holding large food items such as pizza. Gaps between the interlocked tabs 176 and slots 42 provide for the escape of steam from within the container 10. Slots 42 thus prevent the build-up of steam within the container 10 so that the paper board material of the cover 12 will not become impregnated with moisture and weakened thereby. Alternatively, if the cover and tray are coated with a conventional moisture-proof coating, the vent-like slots 42 will prevent moisture from condensing upon the walls of the cover 12 and subsequently dripping down on the pizza or other food item.

Preferred container pieces 12 and 14 have slightly different dimensions relative to each other to provide for a telescopic interlocking therebetween. In accordance with the preferred embodiment of the invention, the perimeter 140 of the constructed tray 14, as defined by its sidewall upper edges 152 and fold line edges 162 is at least equal to the perimeter of the bottom wall 20 of cover 12. Most preferably, the perimeter 140 is just slightly larger than the corresponding perimeter of cover bottom wall 20. Then, when tray 14 is telescopically received by the cover 12 to close container 10, tray sidewalls 122, 124, 126, and 128 come into contact with cover sidewalls 22, 24, 26, and 28. As the cover 12 and tray 14 are urged together into locking engagement, the cover sidewalls 22, 24, 26, and 28 will tend to force the tray sidewalls, 122, 124, 126, and 128 to flex inwardly. Due to their V-cut corners 180, tray sidewalls 122, 124, 126, and 128 are provided with greater flexibility so that they will flex inwardly under the bias applied by the cover sidewalls 22, 24, 26, and 28 as the cover and tray are urged together. Cover sidewalls 22, 24, 26, and 28 also are flexible and will move outwardly as the cover is urged together with tray 14. The inward and outward flexing of tray sidewalls 122 and 126 and corresponding cover sidewalls 22 and 26 is more exaggerated due to tabs 176 which first come into contact with cover sidewalls 22 and 26 Given the resilient nature of the contemplated materials from which cover 12 and tray 14 are formed, when tabs 176 are advanced to reach the slots 42 in cover walls 22 and 26, the tabs will "snap" into the slots to lock the two container pieces together.

The particular dimensions of the container pieces 12 and 14 of course will depend upon the size of the pizza or food item which the completed container 10 is to enclose. However, as an example of the relative sizes of the pieces 12 and 14, a preferred embodiment configured to hold a 12 inch pizza has been contemplated. According to this contemplated embodiment, the bottom wall 120 of tray 14 would be square with a side length of approximately 15 inches. Due to the outward tapering of tray sidewalls 122, 124, 126, and 128 from their connection with bottom wall 120, the perimeter 140 preferably would measure about 15.5 inches on a side. The height of tray sidewalls 122, 124, 126 and 128, which would depend upon the height of their central portions 134, is contemplated as being about 2 inches.

Cover sidewalls 22, 24, 26, and 28 of the contemplated 12 inch pizza container would have heights of about 1.5 inches. Cover bottom wall 20 would measure just slightly less than 15.5 inches on a side. Due to the outward tapering of cover sidewalls 22, 24, 26 and 28, opening 40, defined by the edges 52 of the cover sidewalls would measure slightly over 16 inches on a side.

Figure 4A:
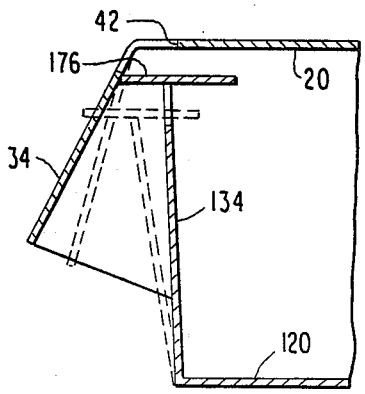
FIG. 4A is a cut-away, sectional view of a portion of the container of FIG. 1, illustrating flexation of a sidewall of the tray and the cover as the tray and cover are urged together to be interlocked.
Figure 4B:
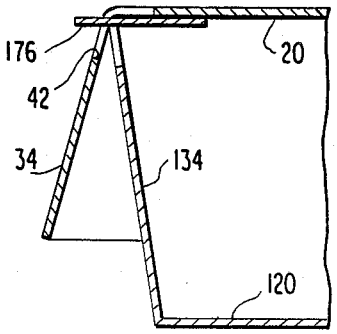
FIG. 4B is view similar to FIG. 4A wherein the cover and tray pieces are fully interlocked.

With reference to FIGS. 1 and 4A and 4B, to close container 10 after the desired contents have been placed on the tray 14, cover 12 is positioned over the tray with their respective openings facing. Cover 12 is oriented with respect to the tray 14 so that cover sidewalls 22 and 26 are located immediately above the tray sidewalls 122 and 126. Thereafter, all that is needed is to press the tray and cover pieces 12 and 14 together.

As the cover 12 is pressed, by hand pressure, onto the tray 14 to telescopically receive the tray, the tray sidewalls 122, 124, 126, and 128 yield inwardly and the cover sidewalls 22, 24, 26, and 28 flex outwardly as illustrated in FIG. 4A. Mitered corners 180 provide for the inward FIG. 4A. Corners 180 with V-shaped cuts 182 provide for the inward 176 are automatically guided into their locking position with their associated slots 42 in cover 12. When the tabs 176 are advanced to slots 42, as depicted in FIG. 4B, they will snap into interlocking engagement within the slots due to the inherent resiliency of the fiber board or like material forming tray 14. As a result, wall 20 of the cover 12 comes to rest upon the upper edges 152 of the four tray sidewalls and all tray sidewalls 122, 124, 126, and 128 will come into flush engagement with their associated cover sidewalls 22, 24, 26, and 28. The rigidity of the tray tabs 176 prevents accidental release thereof and ensures that the complementary pieces will not open until it is desired to open container 10. Of course, this resistance will not be so substantial as to inhibit authorized opening of container 10 due to the flexibility of the materials from which the preferred cove and tray pieces 12 and 14 are fabricated. When it is desired to open container 10, this may be done quite simply, for example, by applying pressure by the thumb to push tabs 176 inwardly and at the same pulling cover sidewalls 122 and 124 with the fingers.

Once the container 10 is opened for removal of the contents, each complementary piece 12 and 14 can provide a serving tray for holding the food while it is being consumed. Where the pieces 12 and 14 have been coated with a conventional grease or fluid-resistant coating, penetration of grease through the pieces will be prevented. Alternatively, since the dimensions of cover wall 20 are larger then those of tray wall 120, the tray with the pizza can be nestably received within the cover so that the container pieces according to the present invention requires less space on a consumer's dinner table, for instance. Also, due to the flexible nature of the material forming the container pieces 12 and 14, preferably paper board and corrugated paper, the complementary pieces may be opened and closed a number of times without destruction of the tabs 176 so that a portion of the contents can be removed from the container and the container can be closed again to keep the remaining food warm.

The container 10 of the present invention is suitable for packaging many different items and in particular food items served for carry-out. The complementary tray and cover pieces 12 and 14 are easily pressed together to close the container. Once the pieces are interlocked, they resist accidental separation to ensure protection of the packaged contents until it is desired to open container 10. Articles such as pizzas or other foods commonly served at carry-out restaurants can be readily packaged in the container according to the present invention.

It is to be understood that the complementary tray and cover pieces of the container according to the present invention need not be of a generally square cross-section as shown in the figures but could be of other shapes as well. There are other various changes and modifications to the disclosed container which can be made by one of ordinary skill in the art, but such changes and/or modifications still would result in a container well within the scope of the invention as set forth in the claims.

What is claimed is:

1. A blank for a tray piece in a two-piece container comprising a cover and a tray, said blank comprising:

a first wall section, and sidewall sections connected to said first wall section, said sidewall sections being upwardly foldable with respect to said first wall to taper outwardly therefrom, said sidewall sections having generally trapezoidal central portions, two opposing sidewall sections each having flap sections connected along a fold lines on the longitudinal end portion thereof, said flap sections each having an edge forming a cut-out section above said fold line with an edge of its respective sidewall, two other opposing sidewall sections having edges located to come into alignment with said edges of said flap sections to form cut-out sections for the corners of said tray when all said sidewall sections are folded upwardly to form said tray.

2. A blank as claimed in claim 1 wherein said two opposing sidewall sections having flap sections each comprise a fold-over section foldably connected to said central portion thereof, said fold-over sections each having a cut line defining a tab which projects outwardly from its sidewall section when said central portion thereof is folded upwardly and said fold-over section is folded-over to form said tray.

3. A tray piece for a two piece container formed of a cover piece which telescopically receives the tray piece, said tray piece comprising:

a bottom wall, and sidewalls which extend upwardly and taper outwardly from said bottom wall and which are joined to form corners for said tray, two opposing sidewalls each having flap sections connected along a fold line on each longitudinal end portion thereof, said flap sections each having an edge in opposition to an edge of their respective sidewall, two other opposing sidewall sections having edges aligned with said edges of said flap sections to provide said corners with cut-out sections.

4. A tray piece as claimed in claim 3, wherein said cut-out sections of said corners are V-shaped.

5. A tray piece as claimed in claim 3, wherein two opposing sidewalls have fold-over portions for forming outwardly projecting tabs.

6. A two piece container comprising a first container piece which telescopically receives a second container piece, said first container piece having a first wall and sidewalls which taper downwardly and outwardly from said first wall thereof, said first piece having slots in at least two of said sidewalls thereof, and said second piece having a first wall and sidewalls which taper upwardly and outwardly from said first wall thereof, at least two of said sidewalls of said second piece including fold-over portions forming outwardly extending tabs receivable within said slots of said first container piece, said sidewalls of said second piece meeting to form corners having cut-out sections therein.

7. A container as claimed in claim 6, wherein said cut-out sections of said second piece are V-shaped.

8. A container as claimed in claim 7, wherein each V-shaped cut-out has sides formed by oppositely tapering edges of two adjacent sidewalls and an edge of a flap portion, said flap portion depending from a central portion of one of said adjacent sidewalls, said edge of said flap portion being in alignment with one of said oppositely tapering edges of said adjacent sidewalls.

9. A container as claimed in claim 8, wherein each of said sidewalls has a generally trapezoidal central portion.

10. A container as claimed in claim 6, wherein upper edges of said second piece define a second piece perimeter which slightly exceeds a perimeter of said first wall of said first piece.

11. A two piece container comprising a first container piece which telescopically receives a second container piece, said first container piece having a first wall and sidewalls which taper downwardly and outwardly from said first wall thereof, and said second piece having a first wall and sidewalls which taper upwardly and outwardly from said first wall thereof and which are joined to form corners, each of said corners having a cut-out section defined by three edges, a first of said three edges being an edge of one sidewall, a second of said edges being an edge of a sidewall adjacent said one sidewall, and the third of said edges being an edge of a flap portion provided with one of said adjacent sidewalls, said third edge being aligned with one of said first or second edges.

12. A container as claimed in claim 11, further comprising locking means for locking said container pieces together in closed telescopic relationship.

13. A container as claimed in claim 12, wherein upper edges of said second piece define a second piece perimeter which is at least as large as a perimeter of said first wall of said first piece, and wherein said locking means locks said pieces together with said upper edges of said second piece coming into contact with said first wall of said first piece.

14. A container as claimed in claim 13, wherein said second perimeter slightly exceeds said perimeter of said first piece first wall.

15. A container as claimed in claim 12, wherein said locking means comprises tabs which project outwardly from opposing sidewalls of said second piece, said first piece having slots therein for receiving said tabs.

16. A container as claimed in claim 15, wherein said tabs are formed by fold-over portions on said opposing sidewalls of said second piece, said fold-over portions being connected to generally trapezoidal central portions of said opposing sidewalls.

* * * * *